US007431977B2

(12) United States Patent
Hessman

(10) Patent No.: US 7,431,977 B2
(45) Date of Patent: Oct. 7, 2008

(54) COATED INSERTS FOR DRY MILLING

(75) Inventor: Ingemar Hessman, Sandviken (SE)

(73) Assignee: Sandvik Intellectual Property AB, Sandviken (SE)

( * ) Notice: Subject to any disclaimer, the term of this patent is extended or adjusted under 35 U.S.C. 154(b) by 365 days.

(21) Appl. No.: 11/261,908

(22) Filed: Oct. 31, 2005

(65) Prior Publication Data

US 2006/0115683 A1 Jun. 1, 2006

(30) Foreign Application Priority Data

Nov. 8, 2004 (SE) ..... 0402709

(51) Int. Cl.
*B32B 9/00* (2006.01)

(52) U.S. Cl. ..... 428/216; 51/307; 51/309; 428/325; 428/336; 428/697; 428/698; 428/699; 428/701

(58) Field of Classification Search ..... 51/307, 51/309; 428/216, 336, 697, 698, 699, 701, 428/325

See application file for complete search history.

(56) References Cited

U.S. PATENT DOCUMENTS

| | | | | |
|---|---|---|---|---|
| 4,610,931 | A | 9/1986 | Nemeth et al. | |
| 5,074,721 | A | 12/1991 | Kress et al. | |
| 5,484,468 | A * | 1/1996 | Ostlund et al. | 75/236 |
| 5,912,051 | A * | 6/1999 | Olsson et al. | 427/248.1 |
| 6,261,673 | B1 | 7/2001 | Reineck et al. | |
| 6,638,609 | B2 | 10/2003 | Nordgren et al. | |
| 7,097,901 | B2 * | 8/2006 | Larsson et al. | 428/216 |
| 7,232,603 | B2 * | 6/2007 | Hessman | 428/698 |
| 2002/0051886 | A1 | 5/2002 | Blomstedt et al. | |
| 2004/0033393 | A1 | 2/2004 | Nordgren et al. | |

FOREIGN PATENT DOCUMENTS

| | | | |
|---|---|---|---|
| EP | 0685572 | A | 12/1995 |
| EP | 0709484 | B | 4/1999 |
| EP | 0753603 | B | 1/2000 |
| EP | 0874919 | B | 2/2002 |
| EP | 1 205 569 | A2 | 5/2002 |
| EP | 1 352 697 | A2 | 10/2003 |
| EP | 1 469 101 | A2 | 10/2004 |
| JP | 01 184218 | A | 7/1989 |
| WO | 01/16389 | A | 3/2001 |

* cited by examiner

*Primary Examiner*—Archene Turner
(74) *Attorney, Agent, or Firm*—Drinker Biddle & Reath LLP

(57) ABSTRACT

Coated milling inserts particularly useful for milling of grey cast iron with or without cast skin under dry conditions at generally high cutting speeds and milling of nodular cast iron and compacted graphite iron with or without cast skin under dry conditions at rather high cutting speeds are disclosed.

The inserts are characterised by a WC—Co cemented carbide with a low content of cubic carbides and a highly W-alloyed binder phase and a coating including an inner layer of $TiC_xN_y$ with columnar grains followed by a wet blasted layer of $\alpha$-$Al_2O_3$.

10 Claims, No Drawings

COATED INSERTS FOR DRY MILLING

BACKGROUND OF THE INVENTION

The present invention relates to coated cemented carbide cutting tool inserts particularly useful for rough milling of highly alloyed grey cast iron, nodular cast iron and compacted graphite iron with or without cast skin under dry conditions, preferably at rather high cutting speeds.

U.S. Pat. No. 6,638,609 discloses coated milling inserts particularly useful for milling of grey cast iron with or without cast skin under wet conditions at low and moderate cutting speeds and milling of nodular cast iron and compacted graphite iron with or without cast skin under wet conditions at moderate cutting speeds. The inserts are characterized by a WC—Co cemented carbide with a low content of cubic carbides and a highly W-alloyed binder phase and a coating including an inner layer of $TiC_xN_y$ with columnar grains followed by a layer of $\kappa$-$Al_2O_3$ and a top layer of TiN.

OBJECTS AND SUMMARY OF THE INVENTION

It is an object of the present invention to provide coated cemented carbide cutting tool inserts, particularly useful for rough milling under dry conditions of highly alloyed grey cast iron, nodular cast iron and compacted graphite iron under dry conditions, preferably at rather high cutting speeds.

In one aspect of the invention there is provided a cutting tool insert a cemented carbide body and a coating wherein said cemented carbide body comprises WC with an average grain size of from about 1.5 to about 2.5 μm, of from about 7.3 to about 7.9 wt-% Co and from about 1.0 to about 1.8 wt % cubic carbides of metals Ta and Nb and a highly W-alloyed binder phase with a CW-ratio of 0.86-0.94 with less than about 3 vol-% eta-phase and said coating comprising:

a first, innermost layer of $TiC_xN_yO_z$ with x+y+z=1, y>x and z less than to about 0.2 with equiaxed grains with size less than about 0.5 μm and a total thickness of from about 0.1 to about 1.5 μm, a layer of $TiC_xN_y$ with x+y=1, x greater than about 0.3 and y greater than about 0.3 with a thickness of from about 4.5 to about 9.5 μm with columnar grains with an average diameter of less than about 5 μm, a layer of a smooth, fine-grained, from about 0.5 to about 2 μm average grain size $\alpha$-$Al_2O_3$ with a thickness of from about 4.5 to about 9.5 μm.

In another aspect of the invention there is provided a method of making a milling insert comprising a cemented carbide body and a coating wherein the WC—Co-based cemented carbide body comprises WC, to from about 7.3 to about 7.9 wt-% Co and from about 1.0 to about 1.8 wt-% cubic carbides of Ta and Nb and a highly W-alloyed binder phase with a CW-ratio of 0.86-0.94, the method comprising the steps of:

depositing by a CVD-method a first, innermost layer of $TiC_xN_yO_z$ with x+y+z=1, y>x and z less than about 0.2 having an equiaxed grain structure with a size less than about 0.5 μm and a total thickness of from about 0.1 to about 1.5 μm, depositing by a MTCVD-technique a layer of $TiC_xN_y$ with x+y=1, x greater than about 0.3 and y greater than about 0.3 with a thickness of from about 4.5 to about 9.5 μm having a columnar grain structure with an average diameter of less than about 5 μm, wherein the MTCVD-technique uses acetonitrile as a source of carbon and nitrogen for forming a layer in a temperature range of from about 700 to about 900° C., depositing a layer of $\alpha$-$Al_2O_3$ with a thickness of from about 4.5 to about 9.5 μm using known CVD-methods and dry blasting said layer with alumina grit in order to obtain smooth surface finish.

In still another aspect of the invention, there is provided the use of the cutting tool insert described above for wet milling using fluid coolant of cast irons such as grey cast iron, compacted graphite iron and nodular iron at a cutting speed of from about 100 to about 300 m/min and a feed of from about 0.15 to about 0.35 mm/tooth.

DETAILED DESCRIPTION OF THE INVENTION

It has now surprisingly been found that cutting tool inserts showing improved properties with respect to the different wear types prevailing at the above mentioned cutting operations can be obtained with cutting tool inserts comprising a cemented carbide body with a relatively high W-alloyed binder phase and with a well balanced chemical composition and grain size of the WC, a columnar $TiC_xN_y$-layer and a wet blasted $\alpha$-$Al_2O_3$-layer.

According to the present invention coated cutting tool inserts are provided of a cemented carbide body with a composition of from about 7.3 to about 7.9 wt % Co, preferably about 7.6 wt % Co, of from about 1.0 to about 1.8 wt % cubic carbides, preferably of from about 1.4 to about 1.7 wt % cubic carbides of the metals Ta and Nb and balance WC. The average grain size of the WC is in the range of about from 1.5 to about 2.5 μm, preferably about 1.8 μm.

The cobalt binder phase is rather highly alloyed with W. The content of W in the binder phase can be expressed as the CW−ratio=$M_s$/(wt−% Co·0.0161), where $M_s$ is the saturation magnetization of the cemented carbide body in $hAm^2/kg$ and wt % Co is the weight percentage of Co in the cemented carbide. The CW-value is a function of the W content in the Co binder phase. A high CW-value corresponds to a low W-content in the binder phase.

It has now been found according to the present invention that improved cutting performance is achieved if the cemented carbide body has a CW-ratio of 0.86-0.94. The cemented carbide may contain small amounts, less than about 3 vol %, of $\eta$-phase ($M_6C$), without any detrimental effect.

The uncoated cutting edge has a radius of 35-60 μm.

The coating comprises:

a first (innermost) layer of $TiC_xN_yO_z$ with x+y+z=1, y>x and z less than 0.2, preferably y greater than about 0.8 and z=0, with equiaxed grains with size less than 0.5 μm and a total thickness less than 1.5 μm, preferably greater than about 0.1 μm, a layer of $TiC_xN_y$ with x+y=1, x greater than about 0.3 and y greater than about 0.3, preferably x greater than or equal to about 0.5, with a thickness of from about 4.5 to about 9.5 μm, preferably from about 5 to about 8 μm, with columnar grains and with an average diameter of less than about 5 μm, preferably from about 0.1 to about 2 μm, a layer of a smooth, fine-grained (average grain size about from about 0.5 to about 2 μm) $Al_2O_3$ consisting essentially of the $\alpha$-phase. However, the layer may contain small amounts (less than about 5 vol-%) of other phases such as $\theta$- or $\kappa$-phase as determined by XRD-measurement. The $Al_2O_3$-layer has a thickness of from about 4.5 to about 9.5 μm, preferably from about 5 to about 8 μm with a surface roughness of preferably $R_{max} \leqq 0.4$ μm over a length of 10 μm.

The present invention also relates to a method of making coated cutting tool inserts of a coated cemented carbide body with a composition of from about 7.3 to about 7.9 wt % Co, preferably about 7.6 wt % Co, from about 1.0 to about 1.8 wt %, preferably from about 1.4 to about 1.7 wt % cubic carbides of the metals Ta and Nb and balance WC. The average grain size of the WC is in the range of from about 1.5 to about 2.5 μm, preferably about 1.8 μm.

The cobalt binder phase is rather highly alloyed with W to a CW-ratio of 0.86-0.94 defined as above. The cemented carbide may contain small amounts, less than about 3 vol %, of η-phase ($M_6C$), without any detrimental effect.

The inserts are dry blasted to from about 35 to about 60 μm edge honing and after that a coating is deposited comprising:

a first (innermost) layer of $TiC_xN_yO_z$ with x+y+z=1, y>x and z less than about 0.2, preferably y greater than about 0.8 and z=0, with equiaxed grains with size less than about 0.5 μm and a total thickness less than about 1.5 μm, preferably greater than about 0.1 μm, using known CVD-methods, a layer of $TiC_xN_y$ with x+y=1, x greater than about 0.3 and y greater than about 0.3, preferably x greater than or equal to about 0.5, with a thickness of from about 4.5 to about 9.5 μm, preferably from about 5 to about 8 μm, with columnar grains and with an average diameter of less than about 5 μm, preferably from about 0.1 to about 2 μm using preferably MTCVD-technique (using acetonitrile as the carbon and nitrogen source for forming the layer in the temperature range of from about 700 to about 900° C.). The exact conditions, however, depend to a certain extent on the design of the equipment used, a layer of a smooth, fine-grained (average grain size of from about 0.5 to about 2 μm) $Al_2O_3$ consisting essentially of the α-phase using known CVD-methods. However, the layer may contain small amounts (less than about 5 vol-%) of other phases such as θ- or κ-phase as determined by XRD-measurement. The $Al_2O_3$-layer has a thickness of from about 4.5 to about 9.5 μm, preferably of from about 5 to about 8 μm.

Finally the inserts are dry blasted with alumina grit in order to obtain smooth surface finish, preferably a surface roughness $R_{max} \leqq 0.4$ μm over a length of 10 μm.

The invention also relates to the use of cutting tool inserts according to above for rough milling under dry conditions of highly alloyed grey cast iron, compacted graphite iron and nodular iron with or without cast skin, at a cutting speed of from about 100 to about 300 m/min and a feed of from about 0.15 to about 0.35 mm/tooth depending on cutting speed and insert geometry.

The invention is additionally illustrated in connection with the following examples, which are to be considered as illustrative of the present invention. It should be understood, however, that the invention is not limited to the specific details of the examples.

EXAMPLE 1

A. Cemented carbide milling inserts in accordance with the invention with the composition 7.6 wt-% Co, 1.25 wt-% TaC, 0.30 wt-% NbC and balance WC with average grain size of 1.8 μm, with a binder phase alloyed with W corresponding to a CW-ratio of 0.87 were coated with a 0.5 μm equiaxed $TiC_{0.05}N_{0.95}$-layer (with a high nitrogen content corresponding to an estimated C/N-ratio of 0.05) followed by a 11 μm thick $TiC_{0.54}N_{0.46}$-layer, with columnar grains by using MTCVD-technique (temperature 850-885° C. and $CH_3CN$ as the carbon/nitrogen source). In subsequent steps during the same coating cycle, a 4 μm thick layer of α-$Al_2O_3$ was deposited using a temperature 970° C. and a concentration of $H_2S$ dopant of 0.4% as disclosed in EP-A-523 021.

The inserts were dry blasted with alumina grit in order to obtain a smooth surface finish.

EXAMPLE 2

Inserts according to the present invention were tested in a face milling of a cylinder block in a highly alloyed grey cast iron Tool: Sandvik Coromant R260.31-250
Number of inserts: 40 PCs
Criterion: Surface finish and work piece frittering.
Reference: TNEF 1204AN-CA in grade Sandvik Coromant GC3020
A: Competitor grade
B: Competitor grade
Cutting data
Cutting speed: Vc=120 m/min
Feed per tooth: Fz=0.2 mm per tooth
Depth of cut: Ap=4 mm
Dry conditions
Tool life reference GC3020 ( prior art) 1000 engine blocks in production.
Tool life of invention 2073 cylinder heads. Average of 5 tests.
Increase of tool life 107% with improved surface finish and productivity.
Tool life competitor A 1187 PCs.
Tool life competitor B 1205 PCs.

EXAMPLE 3

Inserts according to the present invention were tested in a face milling of cylinder heads in highly alloyed grey cast iron Tool: Sandvik Coromant R260.31-315
Number of inserts: 50 PCs
Criteria: Surface finish and work piece frittering.
Reference TNEF 1204AN-WL in grade Sandvik Coromant GC3040
Cutting data
Cutting speed: Vc=283 m/min
Feed per tooth: Fz=0.27 mm per tooth
Depth of cut: Ap=3-5 mm
Dry conditions
Tool life reference GC3040 75 cylinder heads in standard production.
Tool life of invention 231 cylinder heads. Average of 5 tests
Increase of tool life 208% with improved surface finish.

Although the present invention has been described in connection with preferred embodiments thereof, it will be appreciated by those skilled in the art that additions, deletions, modifications, and substitutions not specifically described may be made without department from the spirit and scope of the invention as defined in the appended claims.

The invention claimed is:

1. A cutting tool insert comprising a cemented carbide body and a coating wherein said cemented carbide body comprises WC with an average grain size of from about 1.5 to about 2.5 μm, of from about 7.3 to about 7.9 wt-% Co and from about 1.0 to about 1.8 wt % cubic carbides of metals Ta and Nb and a highly W-alloyed binder phase with a CW-ratio of 0.86-0.94 with less than about 3 vol-% eta-phase and said coating comprising:

a first, innermost layer of $TiC_xN_yO_z$ with x+y+z=1, y>x and z less than about 0.2 with equiaxed grains with size less than about 0.5 μm and a total thickness of from about 0.1 to about 1.5 μm, a layer of $TiC_xN_y$ with x+y=1, x greater than about 0.3 and y greater than about 0.3 with a thickness of from about 4.5 to about 9.5 μm with columnar grains with an average diameter of less than about 5 μm, a layer of a smooth, fine-grained, from about 0.5 to about 2 μm average grain size $\alpha$-$Al_2O_3$ with a thickness of from about 4.5 to about 9.5 μm, wherein said insert has an uncoated cutting edge having a radius of 35-60 μm.

2. The cutting insert of claim 1 wherein the cemented carbide contains to from about 1.4 to about 1.7 wt-% carbides of Ta and Nb.

3. The cutting tool of claim 1 wherein in said first, innermost layer, y is greater than about 0.8 and z=0, in said $TiC_xN_y$ layer, x is greater than or equal to about 0.5 and said layer of $\alpha$-$Al_2O_3$ has a surface roughness or $R_{max}$ less than or equal to about 0.4 μm over a length of 10 μm.

4. The cutting insert of claim 1 wherein the average grain size of WC is about 1.8 μm.

5. The cutting insert of claim 1 wherein the cemented carbide body comprises 7.6 wt-% Co.

6. The cutting insert of claim 1 wherein the thickness of the layer of $TiC_xN_y$ is from about 5 to about 8 μm.

7. The cutting insert of claim 1 wherein the average diameter of the columnar grains in the layer of $TiC_xN_y$ is about 0.1 to about 2 μm.

8. The cutting insert of claim 1 wherein the thickness of the $\alpha$-$Al_2O_3$ layer is about 5 to about 8 μm.

9. The cutting insert of claim 1 wherein a surface roughness of the $\alpha$-$Al_2O_3$ layer is $R_{max} \leqq 0.4$ μm over a length of 10 μm.

10. The cutting insert of claim 1 wherein the $\alpha$-$Al_2O_3$ layer contains >0 to less than 5 vol-% of $\theta$-$Al_2O_3$ or $\kappa$-$Al_2O_3$.

* * * * *